US006214514B1

(12) United States Patent
Evans et al.

(10) Patent No.: US 6,214,514 B1
(45) **Date of Patent: *Apr. 10, 2001**

(54) PROCESS FOR FABRICATING ELECTROPHOTOGRAPHIC IMAGING MEMBER

(75) Inventors: Kent J. Evans, Lima; David A. DeHollander, Fairport; Michael S. Roetker, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/408,346

(22) Filed: Sep. 29, 1999

(51) Int. Cl.[7] ..... G03G 5/047
(52) U.S. Cl. ..... 430/133; 430/132; 430/58.05
(58) Field of Search ..... 430/132, 133, 430/58.05, 129, 134

(56) References Cited

U.S. PATENT DOCUMENTS

| | | | | |
|---|---|---|---|---|
| 3,973,961 | * | 8/1976 | Stroszynski | 430/129 |
| 5,747,208 | * | 5/1998 | Ueda | 430/58.05 |
| 5,798,200 | * | 8/1998 | Maysuura et al. | 430/98 |
| 5,830,614 | | 11/1998 | Pai et al. | 430/59 |
| 6,048,658 | * | 4/2000 | Evans et al. | 430/129 |

OTHER PUBLICATIONS

Diamond, Arthur S. (editor) Handbook of Imaging Materials. New York: Marcel–Dekker, Inc., pp. 396–397, 1991.*
Chemical Abstracts Registry No. 25135–52–8, 2000.*

* cited by examiner

*Primary Examiner*—Christopher Rodee
(74) *Attorney, Agent, or Firm*—John L. Haack; Peter H. Kondo

(57) ABSTRACT

A process for fabricating electrophotographic imaging members including providing an imaging member including a substrate coated with a charge generating layer having an exposed surface, applying a first solution including a charge transporting small molecule and film forming binder to the exposed surface to form a first charge transporting layer having a thickness of greater than about 13 micrometers and less than about 20 micrometers in the dried state and an exposed surface, and applying at least a second solution having a composition substantially identical to the first solution to the exposed surface of the first charge transporting layer to form at least a second continuous charge transporting layer, the at least second charge transporting layer having a thickness in the dried state less than about 20 micrometers in the dried state, the at least second charge transporting layer, and any subsequent applied solution having a composition substantially identical to the first solution.

6 Claims, 4 Drawing Sheets

FIG. 1
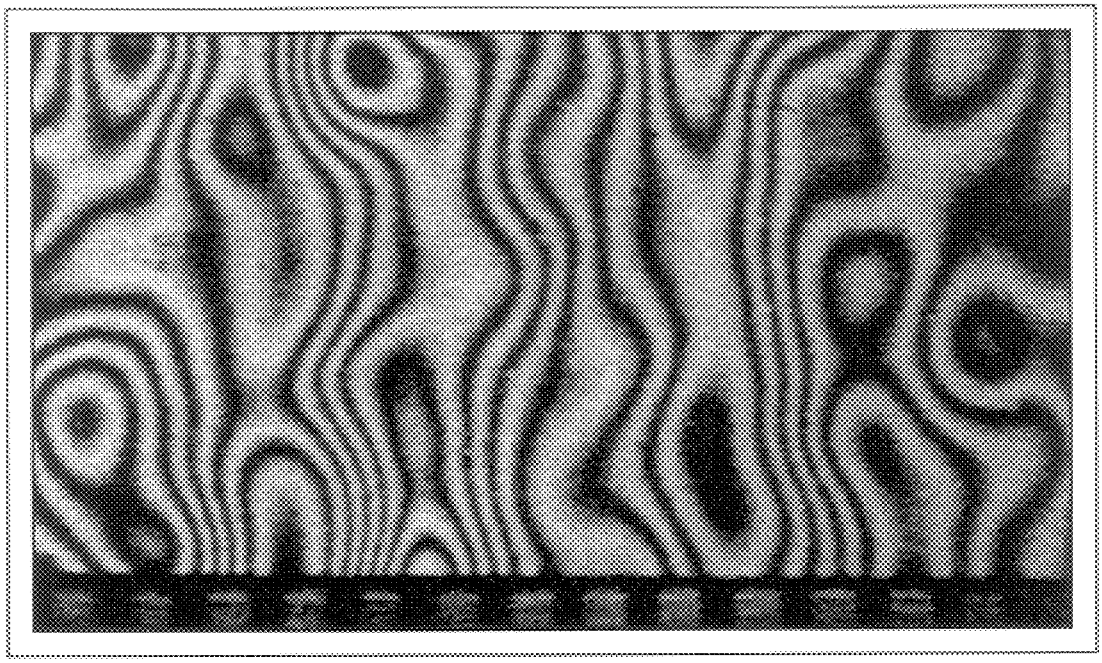
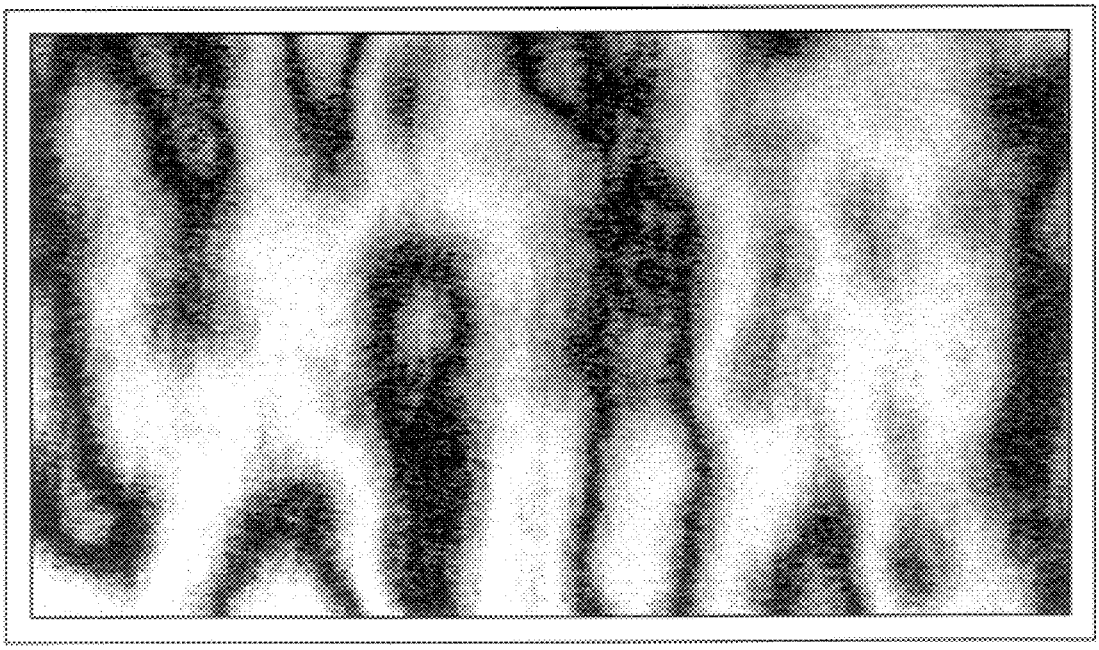
FIG. 2

FIG. 4
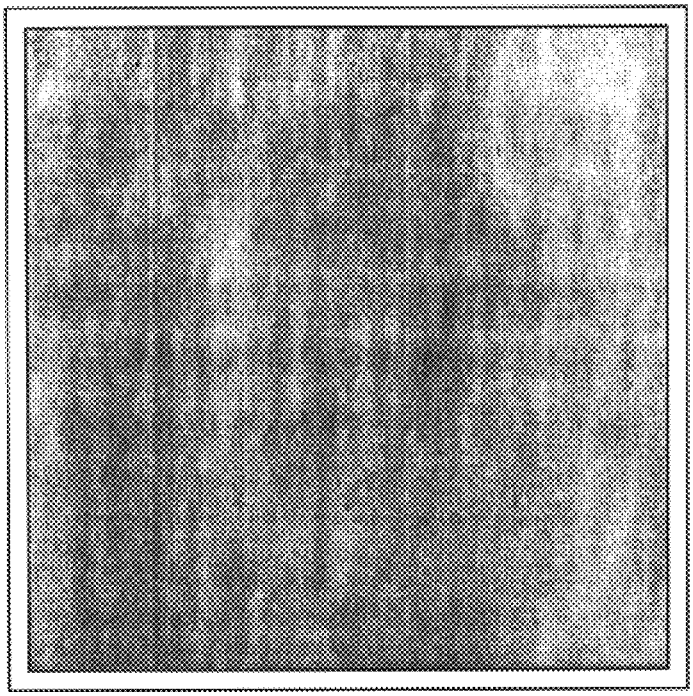
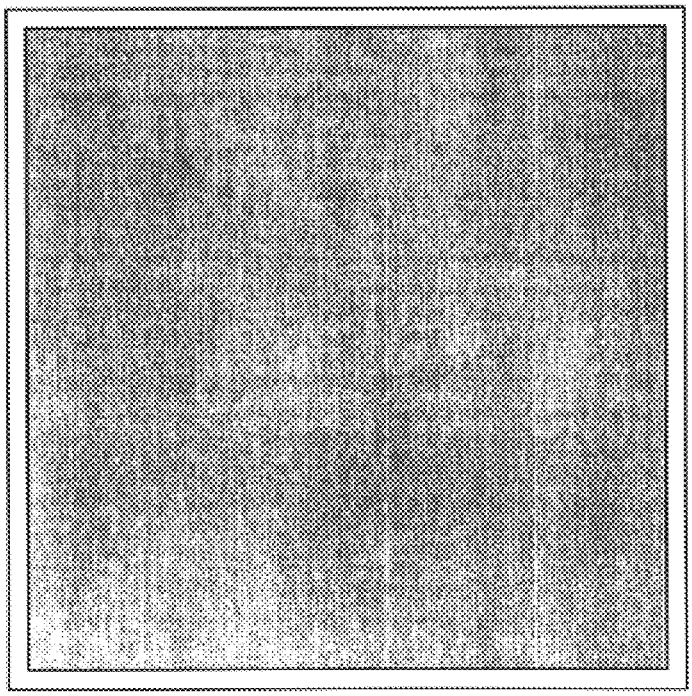
FIG. 5

FIG. 6
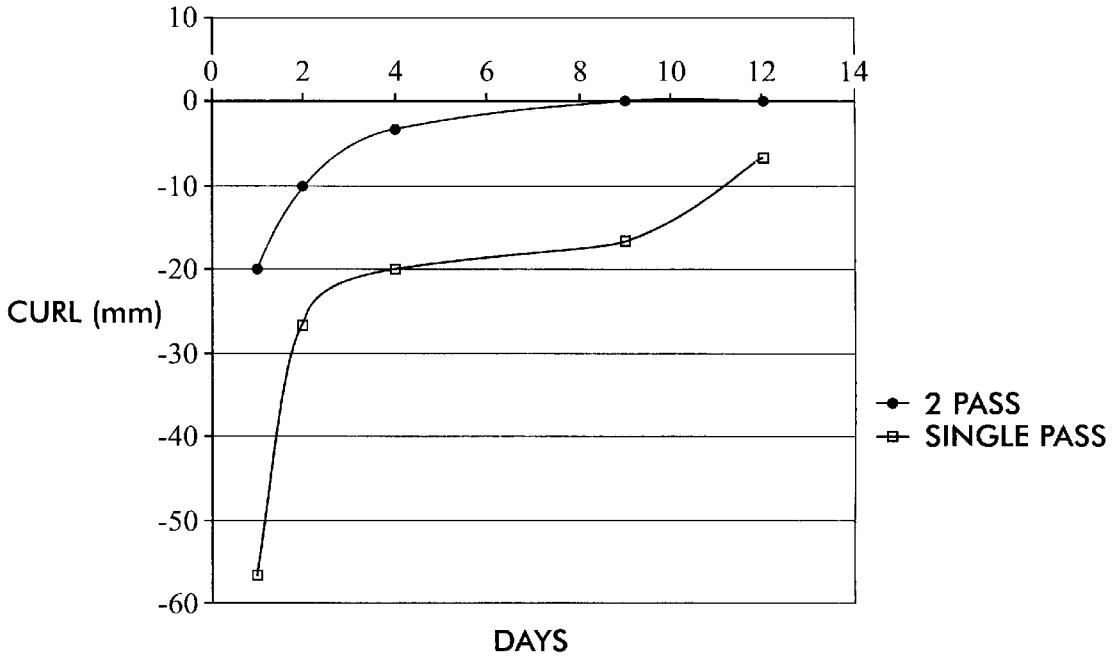
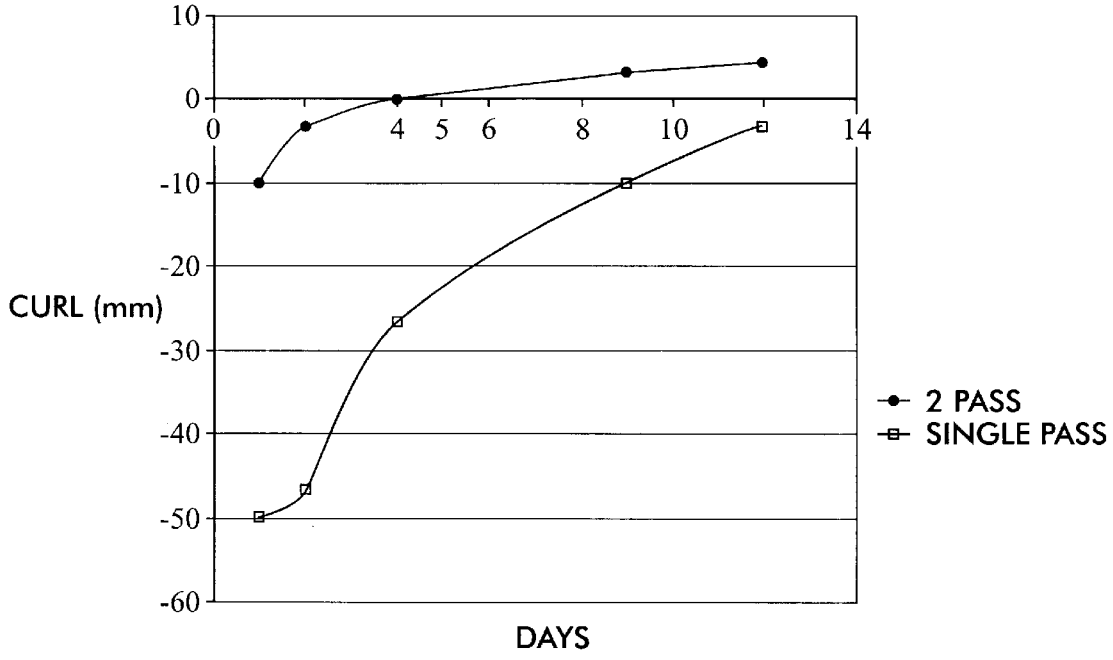
FIG. 7

PROCESS FOR FABRICATING ELECTROPHOTOGRAPHIC IMAGING MEMBER

BACKGROUND OF THE INVENTION

This invention relates in general to a process for fabricating electrophotographic imaging members, and, more specifically, to the formation of a charge transport layer Typical electrophotographic imaging members comprise a photoconductive layer comprising a single layer or composite layers. One type of composite photoconductive layer used in xerography is illustrated, for example, in U.S. Pat. No. 4,265,990 which describes a photosensitive member having at least two electrically operative layers. The disclosure of this patent is incorporated herein in its entirety. One layer comprises a photoconductive layer which is capable of photogenerating holes and injecting the photogenerated holes into a contiguous charge transport layer. Generally, where the two electrically operative layers are supported on a conductive layer the photogenerating layer is sandwiched between the contiguous charge transport layer and the supporting conductive layer, the outer surface of the charge transport layer is normally charged with a uniform electrostatic charge. The photosensitive member is then exposed to a pattern of activating electromagnetic radiation such as light, which selectively dissipates the charge in illuminated areas of the photosensitive member while leaving behind an electrostatic latent image in the non-illuminated areas. This electrostatic latent image may then be developed to form a visible image by depositing finely divided electrostatic toner particles on the surface of the photosensitive member. The resulting visible toner image can be transferred to a suitable receiving material such as paper. This imaging process may be repeated many times with reusable photosensitive members.

As more advanced, complex, highly sophisticated, electrophotographic copiers, duplicators and printers were developed, greater demands were placed on the photoreceptor to meet stringent requirements for the production of high quality images. For example, the numerous layers found in many modern photoconductive imaging members must be uniform, free of defects, adhere well to adjacent layers, and exhibit predictable electrical characteristics within narrow operating limits to provide excellent toner images over many thousands of cycles. One type of multilayered photoreceptor that has been employed as a drum or belt in electrophotographic imaging systems comprises a substrate, a conductive layer, a charge blocking layer, an adhesive layer, a charge generating layer, and a charge transport layer. This photoreceptor may also comprise additional layers such as an overcoating layer. Although excellent toner images may be obtained with multilayered photoreceptors, it has been found that the numerous layers limit the versatility of the multilayered photoreceptor. For example, when a thick, e.g., 29 micrometers, layer of a charge transport layer is formed in a single pass a raindrop pattern to form on the exposed imaging surface of the final dried photoreceptor. This raindrop phenomenon is a print defect caused by the coating thickness variations (high frequency) in photoreceptors having a relatively thick (e.g., 29 micrometers) charge transport layer. More specifically, the expression "raindrop", as employed herein, is defined as a high frequency variation in the transport layer thickness. The period of variation is in the 0.1 cm to 2.5 cm range. The amplitude of variation is between 0.5 micrometer and 1.5 micrometers. The variation can also be defined on a per unit area basis. Raindrop can occur with the transport layer thickness variation is in the range of 0.5 to 1.5 microns per sq. cm. The morphological structure of raindrop is variable depends on where and how the device is coated. The structure can be periodic or random, symmetrical or oriented.

INFORMATION DISCLOSURE STATEMENT

U.S. Pat. No. 5,830,614 to Pai et al., issued Nov. 3, 1998—A charge transport dual layer is disclosed for use in a multilayer photoreceptor comprising a support layer, a charge generating layer and a charge transport dual layer including a first transport layer containing a charge-transporting polymer, and a second transport layer containing a charge-transporting polymer having a lower weight percent of charge transporting segments than the charge-transporting polymer in the first transport layer. This structure has greater resistance to corona effects and provides for a longer service life. The charge-transporting polymers preferably comprise polymeric arylamine compounds While the above mentioned electrophotographic imaging members may be suitable for their intended purposes, there continues to be a need for improved imaging members, particularly for methods for fabricating multilayered electrophotographic imaging members in flexible belts

CROSS REFERENCE TO COPENDING APPLICATIONS

U.S. application Ser. No. 09/408,239 now U.S. Pat. No. 6,048,658 entitled "Process For Fabricating Electrophotographic Imaging Member" filed concurrently herewith in the names of K. J. Evans et al. now U.S. Pat. No. 6,048,658, issued Apr. 11, 2000. A process for fabricating electrophotographic imaging members is disclosed comprising providing a substrate with an exposed surface, simultaneously applying, from a coating die, two wet coatings to the surface, the wet coatings comprising a first coating in contact with the surface, the first coating comprising photoconductive particles dispersed in a solution of a film forming binder and a predetermined amount of solvent for the binder and a second coating in contact with the first coating, the second coating comprising a solution of a charge transporting small molecule and a film forming binder dissolved in a predetermined amount of solvent for the transport molecule and the binder, drying the two wet coatings to remove substantially all of the solvents to form a dry first coating having a thickness between about 0.1 micrometer and about 10 micrometers and dry second coating having a thickness between about 4 micrometers and 20 micrometers, applying at least a third coating in contact with the second coating, the third coating comprising a solution containing having a charge transporting small molecule, film forming binder and solvent substantially identical to charge transporting small molecule, film forming binder and solvent in the second coating, and drying the third coating to from a dry third coating having a thickness between about 13 micrometers and 20 micrometers.

BRIEF SUMMARY OF THE INVENTION

It is, therefore, an object of the present invention to provide an improved process for fabricating an electrophotographic imaging member.

It is another object of the present invention to provide an improved process for achieving coating uniformity in a charge transport layer.

It is still another object of the present invention to provide an improved process for eliminating raindrop defects in charge transport layers.

It is yet another object of the present invention to provide an improved process for reducing curl in electrophotographic imaging members.

The foregoing objects and others are accomplished in accordance with this invention by providing a process for fabricating electrophotographic imaging members comprising providing an imaging member comprising a substrate coated with a charge generating layer having an exposed surface, applying a first solution comprising a charge transporting small molecule and film forming binder to the exposed surface to form a first continuous charge transporting layer having a thickness greater than about 13 micrometers and less than about 20 micrometers after drying, and applying at least a second solution having a composition substantially identical to the first solution to the exposed surface of the first charge transporting layer to form at least a second continuous charge transporting layer having a thickness greater than about 13 micrometers and less than about 20 micrometers.

In order to achieve the uniformity required to eliminate the raindrop defect, the first and second layer thicknesses and the coating solution must meet certain requirements. More specifically, the first application of solution must be such that the dried state thickness is less about 20 micrometers. In addition, experience has shown that the minimum thickness of the first solution must be greater than about 13 micrometers in the dried state to get a continuous film. The expression "dried state" as employed herein is defined as a residual solvent content of less that about 10% by weight, based on the total weight of the dried layer.

The second application must also be such the dried state thickness is less about 20 micrometers. In addition, experience has shown that the minimum thickness of the second solution must also be greater than about 13 micrometers in the dried state to get a continuous film.

The total solution solids should be greater than about 13 weight percent for the combined loading of small charge transport molecule and film forming binder and the solution viscosity is should be greater than about 400 cp.

Mathematically the requirements can be expressed as follows:

$$\delta = L1 + L2,$$

Where:

$$13 \sim < L1, L2 \sim < 20$$

and:

δ, L1, and L2 are dried layer thickness in micrometers.

Generally, photoreceptors comprise a supporting substrate having an electrically conductive surface layer, an optional charge blocking layer on the electrically conductive surface, an optional adhesive layer, a charge generating layer on the blocking layer and a transport layer on the charge generating layer.

The supporting substrate may be opaque or substantially transparent and may be fabricated from various materials having the requisite mechanical properties. The supporting substrate may comprise electrically non-conductive or conductive, inorganic or organic composition materials. The supporting substrate may be rigid or flexible and may have a number of different configurations such as, for example, a cylinder, sheet, a scroll, an endless flexible belt, or the like. Preferably, the supporting substrate is in the form of an endless flexible belt and comprises a commercially available biaxially oriented polyester known as Mylar® available from E. I. du Pont de Nemours & Co. or Melinex® available from ICI. Exemplary electrically non-conducing materials known for this purpose include polyesters, polycarbonates, polyamides, polyurethanes, and the like.

The average thickness of the supporting substrate depends on numerous factors, including economic considerations. A flexible belt may be of substantial thickness, for example, over 200 micrometers, or have a minimum thickness less than 50 micrometers, provided there are no adverse affects on the final multilayer photoreceptor device. In one flexible belt embodiment, the average thickness of the support layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers.

The electrically conductive surface layer may vary in average thickness over substantially wide ranges depending on the optical transparency and flexibility desired for the multilayer photoreceptor. Accordingly, when a flexible multilayer photoreceptor is desired, the thickness of the electrically conductive surface layer may be between about 20 Angstrom units to about 750 Angstrom units, and more preferably from about 50 Angstrom units to about 200 Angstrom units for a preferred combination of electrical conductivity, flexibility and light transmission. The electrically conductive surface layer may be a metal layer formed, for example, on the support layer by a coating technique, such as a vacuum deposition. Typical metals employed for this purpose include aluminum, zirconium, niobium, tantalum, vanadium and hafnium, titanium, nickel, stainless steel, chromium, tungsten, molybdenum, and the like. Useful metal alloys may contain two or more metals such as zirconium, niobium, tantalum, vanadium and hafnium, titanium, nickel, stainless steel, chromium, tungsten, molybdenum, and the like. Regardless of the technique employed to form the metal layer, a thin layer of metal oxide may form on the outer surface of most metals upon exposure to air. Thus, when other layers overlying a (metal) electrically conductive surface layer are described as "contiguous" layers, it is intended that these overlying contiguous layers may, in fact, contact a thin metal oxide layer that has formed on the outer surface of the oxidizable metal layer. An average thickness of between about 30 Angstrom units and about 60 Angstrom units is preferred for the thin metal oxide layers for improved electrical behavior. Generally, for rear erase exposure, a conductive layer light transparency of at least about 15 percent is desirable. The light transparency allows the design of machines employing erase from the rear. The electrically conductive surface layer need not be limited to metals. Other examples of conductive layers may be combinations of materials such as conductive indium-tin oxide as a transparent layer for light having a wavelength between about 4000 Angstroms and about 7000 Angstroms or a conductive carbon black dispersed in a plastic binder as an opaque conductive layer.

After deposition of the electrically conductive surface layer, an optional blocking layer may be applied thereto. Generally, electron blocking layers for positively charged photoreceptors allow holes from the imaging surface of the photoreceptor to migrate toward the conductive layer. For use in negatively charged systems any suitable blocking layer capable of forming an electronic barrier to holes between the adjacent multilayer photoreceptor layers and the underlying conductive layer may be utilized. The blocking layer may be organic or inorganic and may be deposited by any suitable technique. For example, if the blocking layer is soluble in a solvent, it may be applied as a solution and the solvent can subsequently be removed by any conventional method such as by drying. Typical blocking layers include polyvinylbutyral, organosilanes, epoxy resins, polyesters, polyamides, polyurethanes, pyroxyline vinylidene chloride resin, silicone resins, fluorocarbon resins and the like containing an organo-metallic salt. Other blocking layer materials include nitrogen—containing siloxanes or nitrogen—containing titanium compounds such as trimethoxysilyl propylene diamine, hydrolyzed trimethoxysilylpropylethylene diamine, N-beta-(aminoethyl)-gammaaminopropyltrimethoxy silane, isopropyl-4-aminobenzene sulfonyl, di(dodecylbenzene sulfonyl) titanate, isopropyl-di (4-aminobenzoyl)isostearoyl titanate, isopropyl-tri(N-ethylamino-ethylamino) titanate, isopropyl trianthranil titanate, isopropyl-tri-(N,N-dimethylethylamino) titanate, titanium-4-amino benzene sulfonatoxyacetate, titanium 4-aminobenzoate-isostearate-oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyldiethoxy silane, as disclosed in U.S. Pat. Nos. 4,291,110, 4,338,387, 4,286,033 and 4,291,110, the entire disclosures of these patents being incorporated herein by reference. The blocking layer may comprise a reaction product between a hydrolyzed silane and a thin metal oxide layer formed on the outer surface of an oxidizable metal electrically conductive surface.

The blocking layer should be continuous and usually has an average thickness of less than about 5000 Angstrom units. A blocking layer of between about 50 Angstrom units and about 3000 Angstrom units is preferred because charge neutralization after light exposure of the multilayer photoreceptor is facilitated and improved electrical performance is achieved. The blocking layer may be applied by a suitable technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by techniques such as by vacuum, heating and the like. Generally, a weight ratio of blocking layer material and solvent of between about 0.05:100 and about 0.5:100 is satisfactory for spray coating. A typical siloxane coating is described in U.S. Pat. No. 4,464,450, the entire disclosure thereof being incorporated herein by reference If desired, an optional adhesive layer may be applied to the hole blocking layer or conductive surface. Typical adhesive layers include a polyester resin such as Vitel PE-100®, Vitel PE-200®, Vitel PE-200D®, and Vitel PE-222®, all available from Goodyear Tire and Rubber Co., duPont 49,000 polyester, polyvinyl butyral, and the like. When an adhesive layer is employed, it should be continuous and, preferably, have an average dry thickness between about 200 Angstrom units and about 900 Angstrom units and more preferably between about 400 Angstrom units and about 700 Angstrom units. Any suitable solvent or solvent mixtures may be employed to form a coating solution of the adhesive layer material. Typical solvents include tetrahydrofuran, toluene, methylene chloride, cyclohexanone, and mixtures thereof. Generally, for example, to achieve a continuous adhesive layer dry thickness of about 900 Angstroms or less by gravure coating techniques, the preferred solids concentration is about 2 percent to about 5 percent by weight based on the total weight of the coating mixture of resin and solvent. However, any suitable technique may be utilized to mix and thereafter apply the adhesive layer coating mixture to the charge blocking layer. Typical application techniques include spraying, dip coating, roll coating, wire wound rod coating, and the like. Drying of the deposited coating may be effected by a suitable technique such as oven drying, infra red radiation drying, air drying and the like.

A charge generating layer is applied to the blocking layer, or adhesive layer if either are employed, which can then be overcoated with charge transport layers as described herein. Examples of charge generating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine described in U.S. Pat. No. 3,357,989, metal phthalocyanines such as vanadyl phthalocyanine, titanyl phthalocyanines and copper phthalocyanine, quinacridones available from DuPont under the trade name Monastral Red®, Monastral Violet® and Monastral Red Y®. Vat Orange 1® and Vat Orange 3® are trade names for dibromoanthrone pigments, benzimidazole perylene, substituted 3,4-diaminotriazines disclosed in U.S. Pat. No. 3,442,781, polynuclear aromatic quinones available from Allied Chemical Corporation under the tradename Indofast Double Scarlet®, Indofast Violet Lake B®. Indofast Brilliant Scarlet® and Indofast Orange®, and the like dispersed in a film forming polymeric binder. Selenium, selenium alloy, benzimidazole perylene, and the like and mixtures thereof, may be formed as a continuous, homogeneous charge generating layer. Benzimidazole perylene compositions are well known and described, for example, in U.S. Pat. No. 4,587,189. Multiphotogenerating layer compositions may be utilized wherein an additional photoconductive layer may enhance or reduce the properties of the charge generating layer. Examples of this type of configuration are described in U.S. Pat. No. 4,415,639. Other suitable charge generating materials known in the art may also be utilized, if desired. Charge generating binder layers comprising particles or layers including a photoconductive material such as vanadyl phthalocyanine, titanyl phthalocyanines, metal-free phthalocyanine, benzimidazole perylene, amorphous selenium, trigonal selenium, selenium alloys such as selenium-tellurium, selenium-tellurium-arsenic, selenium arsenide and the like, and mixtures thereof, are especially preferred because of their sensitivity to white light. Vanadyl phthalocyanine, titanyl phthalocyanines, metal free phthalocyanine and tellurium alloys are also preferred because these materials provide the additional benefit of being sensitive to infra-red light.

Numerous inactive resin materials may be employed in the charge generating binder layer including those described, for example, in U.S. Pat. No. 3,121,006. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, and the like. These polymers may be block, random or alternating copolymers.

An active transporting polymer containing charge transporting segments may also be employed as the binder in the charge generating layer. These polymers are particularly useful where the concentration of carrier-generating pigment particles is low and the average thickness of the carrier-generating layer is substantially thicker than about 0.7 micrometer. The active polymer commonly used as a binder is polyvinylcarbazole whose function is to transport carriers which would otherwise be trapped in the layer.

Electrically active polymeric arylamine compounds can be employed in the charge generating layer to replace the polyvinylcarbazole binder or another active or inactive binder. Part or all of the active resin materials to be employed in the charge generating layer may be replaced by electrically active polymeric arylamine compounds.

The photogenerating composition or pigment is present in the resinous binder composition in various amounts, generally, however, from about 5 percent by volume to about 90 percent by volume of the photogenerating pigment is dispersed in about 95 percent by volume to about 10 percent by volume of the resinous binder, and preferably from about 20 percent by volume to about 30 percent by volume of the photogenerating pigment is dispersed in about 80 percent by volume to about 70 percent by volume of the resinous binder composition. In one embodiment about 8 percent by volume of the photogenerating pigment is dispersed in about 92 percent by volume of the resinous binder composition.

For embodiments in which the charge generating layers do not contain a resinous binder, the charge generating layer may comprise any suitable, well known homogeneous photogenerating material. Typical homogenous photogenerating materials include inorganic photoconductive compounds such as amorphous selenium, selenium alloys selected such as selenium-tellurium, selenium-tellurium-arsenic, and selenium arsenide and organic materials such as benzamidazole perylene, vanadyl phthalocyanine, chlorindium phthalocyanine, chloraluminum phthalocyanine, and the like.

The charge generating layer containing photoconductive compositions and/or pigments and the resinous binder material generally ranges in average thickness from about 0.1 micrometer to about 5 micrometers, and preferably has an average thickness from about 0.3 micrometer to about 3 micrometers. The charge generating layer thickness is related to binder content. Higher binder content compositions generally require thicker layers for photogeneration. Thicknesses outside these ranges can be selected providing the objectives of the present invention are achieved.

The active charge transport layer may comprise any suitable non-polymeric small molecule charge transport material capable of supporting the injection of photogenerated holes and electrons from the charge generating layer and allowing the transport of these holes or electrons through the charge transport layer to selectively discharge the surface charge. The active charge transport layer not only serves to transport holes or electrons, but also protects the charge generator layer from abrasion or chemical attack and therefor extends the operating life of the photoreceptor imaging member. Thus, the active charge transport layer is a substantially non-photoconductive material which supports the injection of photogenerated holes or electrons from the generation layer. The active transport layer is normally transparent when exposure is effected through the active layer to ensure that most of the incident radiation is utilized by the underlying charge generator layer for efficient photogeneration. The charge transport layer in conjunction with the generation layer in the instant invention is a material which is an insulator to the extent that an electrostatic charge placed on the transport layer is not conducted in the absence of activating illumination. For reasons of convenience, discussion will refer to charge carriers or hole transport. However, transport of electrons is also contemplated as within the scope of this invention.

Any suitable soluble non-polymeric small molecule transport material may be employed in the charge transport layer coating mixture. This small molecule transport material is dispersed in an electrically inactive polymeric film forming materials to make these materials electrically active. These non-polymeric activating materials are added to film forming polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Any suitable non-polymeric small molecule charge transport material which is soluble or dispersible on a molecular scale in a film forming binder may be utilized in the continuous phase of the charge transporting layer of this invention. The charge transport molecule should be capable of transporting charge carriers injected by the charge injection enabling particles in an applied electric field. The charge transport molecules may be hole transport molecules or electron transport molecules. Typical charge transporting materials include the following:

Diamine transport molecules of the types described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(alkylphenyl)-[1,1'-biphenyl]-4,4'-diamine wherein the alkyl is, for example, methyl, ethyl, propyl, n-butyl, etc. such as N,N'-diphenyl-N,N'-bis(3"-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2'4'-dimethoxybenzylidene)fluorene, 2-nitro-9-benzylidene-fluorene, 2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944.

Hydrazone including, for example, p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazore transport molecules described, for example in U.S. Pat. Nos. 4,385,106, 4,338,388, 4,387,147, 4,399,208, 4,399,207.

Still another charge transport molecule is a carbazole phenyl hydrazone. Typical examples of carbazole phenyl hydrazone transport molecules include 9-methylcarbazole-3-carbaldehyde- 1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. 4,256,821. Similar hydrazone transport molecules are described, for example, in U.S. Pat. No. 4,297,426.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989.

The charge transport layer forming solution preferably comprises an aromatic amine compound as the activating compound. An especially preferred charge transport layer composition employed to fabricate the two or more charge transport layer coatings of this invention preferably comprises from about 35 percent to about 45 percent by weight of at least one charge transporting aromatic amine compound, and about 65 percent to about 55 percent by weight of a polymeric film forming resin in which the aromatic amine is soluble. The substituents should be free from electron withdrawing groups such as $NO_2$ groups, CN groups, and the like. Typical aromatic amine compounds include, for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, 1,1'-biphenyl)-4,4'-diamine, and the like dispersed in an inactive resin binder.

Examples of electrophotographic imaging members having at least two electrically operative layers, including a charge generator layer and diamine containing transport layer, are disclosed in U.S. Pat. Nos. 4,265,990, 4,233,384, 4,306,008, 4,299,897 and 4,439,507, the entire disclosures thereof being incorporated herein by reference.

Any suitable soluble inactive film forming binder may be utilized in the charge transporting layer coating mixture. The inactive polymeric film forming binder may be soluble, for example, in methylene chloride, chlorobenzene or other suitable solvent. Typical inactive polymeric film forming binders include polycarbonate resin, polyester, polyarylate, polyacrylate, polyether, polysulfone, and the like. Molecular weights can vary, for example, from about 20,000 to about 1,500,000. An especially preferred film forming polymer for charge transport layer is polycarbonates. Typical film forming polymer polycarbonates include, for example, bisphenol polycarbonate, poly(4,4'-isopropylidene diphenyl carbonate), 4,4'-cyclohexylidene diphenyl polycarbonate, bisphenol A type polycarbonate of 4,4'-isopropylidene (commercially available form Bayer AG as Makrolon), poly(4,4'-diphenyl-1,1'-cyclohexane carbonate) and the like. The polycarbonate resins typically employed for charge transport layer applications have a weight average molecular weight from about 70,000 to about 150,000.

Any suitable extrusion coating technique may be employed to form the charge transport layer coatings. Typical extrusion techniques include, for example, slot coating, slide coating, curtain coating, and the like.

The wet extruded charge transport layers should be continuous and sufficiently thick to provide the desired predetermined dried layer thicknesses. The maximum wet thickness of the deposited layer depends upon the solids concentration of the coating mixture being extruded. The expression "solids", as employed herein refers to the materials that are normally solids in the pure state at room temperature. In other words, solids are generally those materials in the coating solution that are not solvents. The relative proportion of solvent to solids in the coating solution varies depending upon the specific coating materials used, type of coating applicator selected, and relative speed between the applicator and the object being coated. Preferably, the solids concentration range is greater than about 13 percent total solids, based the weight of the coating solution. The maximum solids concentration is determined by the combined solubility of the small molecule with film forming binder components in the solvent of choice. For example in methylene chloride, this limit is in the range of about 18 percent to about 20 percent total solids. Moreover, it is preferred that the viscosity of the coating solution is between about 400 and about 1500 centipoises for satisfactory flowability and coatability. Highly dilute coating solutions of low viscosity can cause raindrop patterns to form.

Generally, in the sequential charge transport layer coating process of this invention, each extruded layer should have a thickness of greater than about 13 micrometers and less than about 20 micrometers in the dried state. When the extruded layer has a thickness greater than about 20 micrometers in the dried state, an undesirable raindrop pattern appears in the final toner images formed during image cycling. When the extruded layer has a thickness less than about 13 micrometers in the dried state, bead breaks occur during the coating process. When only two charge transport layers are deposited, the first layer preferably has a thickness in the dried state of greater than about 13 micrometers and less than about 20 micrometers and the second layer preferably has a thickness in the dried state of greater than about 13 micrometers and less than about 20 micrometers. The total combined thickness of both extruded charge transport layers in the dried state should be greater than about 26 micrometers and less than about 40 micrometers.

When three charge transport layers are deposited, each layer preferably has a thickness in the dried state of greater than about 13 micrometers and less than about 20 micrometers and the total combined thickness of all three extruded charge transport layers in the dried state should be greater than about 39 micrometers and less than about 60 micrometers.

When four charge transport layers are deposited, the each layer preferably has a thickness in the dried state of greater than about 13 micrometers and less than about 20 micrometers and the total combined thickness of both extruded charge transport layers in the dried state should be greater than about 52 micrometers and less than about 80 micrometers.

Drying of each deposited charge transport layer coating may be effected by any suitable conventional technique such as oven drying, infra red radiation drying, air drying and the like. In general, the ratio of the thickness of the final dried combination of charge transport layers to the charge generator layer after drying is preferably maintained from about 2:1 to 8:1.

If desired, after formation the charge transport layers, the resulting electrophotographic imaging member may optionally be coated with any suitable overcoating layer.

Other layers such as conventional ground strips comprising, for example, conductive particles dispersed in a film-forming binder may be applied to one edge of the multilayer photoreceptor in contact with the conductive surface, blocking layer, adhesive layer or charge generating layer.

In some cases a back coating may be applied to the side opposite the multilayer photoreceptor to provide flatness and/or abrasion resistance. This backcoating layer may comprise an organic polymer or inorganic polymer that is electrically insulating or slightly semi-conductive.

The multilayer photoreceptor of the present invention may be employed in any suitable and conventional electrophotographic imaging process which utilizes charging prior to imagewise exposure to activating electromagnetic radiation. Conventional positive or reversal development techniques may be employed to form a marking material image on the imaging surface of the electrophotographic imaging member of this invention.

BRIEF DESCRIPTION OF THE DRAWINGS

A more complete understanding of the process of the present invention can be obtained by reference to the accompanying drawings wherein:

FIG. 1 illustrates a monochromatic interference image of high frequency thickness variability of a charge transport layer of a control photoreceptor.

FIG. 2 illustrates a monochromatic interference image of high frequency thickness variability of a first charge transport layer of a photoreceptor of this invention.

FIG. 4 is a print test result from a control photoreceptor.

FIG. 5 is a print test result from a photoreceptor of this invention.

FIG. 6 compares the cross process photoreceptor curl of this invention with a control photoreceptor.

FIG. 7 compares the machine direction photoreceptor curl (down process) of this invention with a control photoreceptor.

Figure 3:
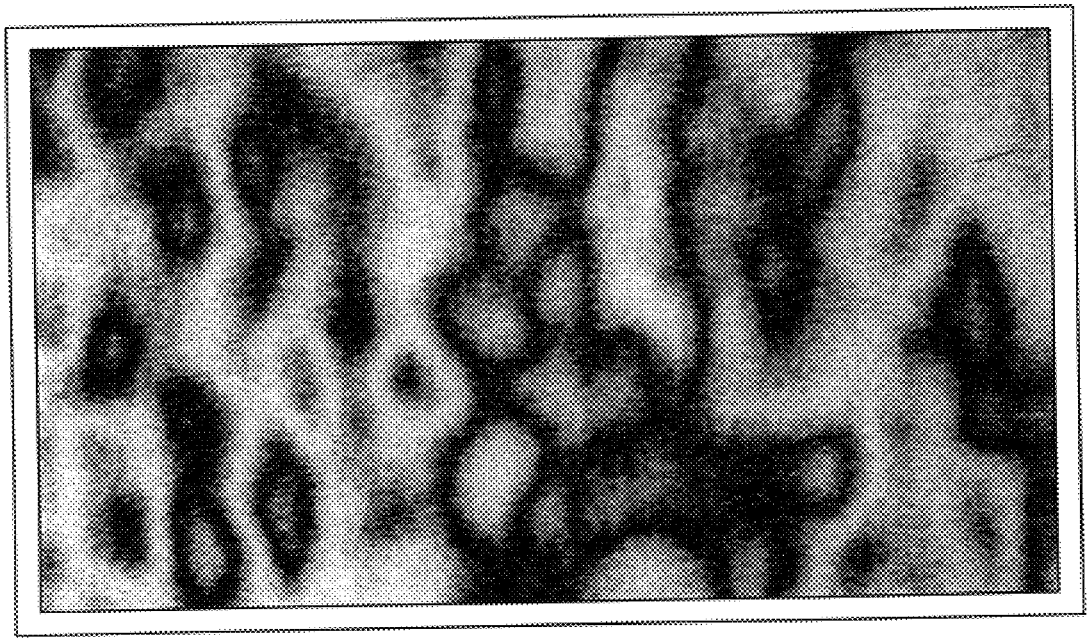
FIG. 3 illustrates a monochromatic interference image of high frequency thickness variability of the combination of a first charge transport layer and second charge transport layer of a photoreceptor of this invention.

These Figures are referred to in greater detail in the following Working Examples.

PREFERRED EMBODIMENTS OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A photoreceptor was prepared by forming coatings using conventional coating techniques on a substrate comprising vacuum deposited titanium layer on a polyethylene terephthalate film (Melinex®, available from ICI). The first coating was a siloxane blocking layer formed from hydrolyzed gamma aminopropyltriethoxysilane having a dried thickness of 0.005 micrometer (50 Angstroms). The second coating was an adhesive layer of polyester resin (49,000, available from E. I. duPont de Nemours & Co.) having a dried thickness of 0.005 micrometer (50 Angstroms). The next coating was a charge generator layer containing 2.9 percent by weight benzimidazole perylene particles, dispersed in 2.9 percent by weight poly(4,4-diphenyl-1,1-cyclohexne carbonate) film forming binder (PCZ-200, available from Mitsubishi Gas) having an optical density of 2.0 (a dried thickness of about 1.0 micrometer). A charge transport layer was formed on the charge generator layer by depositing a single coating with a slot coating die in a single coating pass, the coating containing a solution of 6.5 percent by weight N,N'-diphenyl-N,N'-bis(3- methylphenyl)-(1,1' biphenyl)-4, 4' diamine, 8.5 percent by weight poly(4,4-isopropylidene-diphenylene) carbonate film forming binder (Makrolon, available from Bayer), and 85 percent by weight methylene chloride solvent. The viscosity of this solution was about 800 centipoises. The extrusion die had a slot height of 457 micrometers. The coating wet thickness was 186 microns. This coating was dried in a 5 zone drier with the following time/temperature profile:

TABLE 1

Dryer Time/Temperature Profile - Transport Layer

| Zone | Temperature, ° C. | Residence Time, sec. |
|---|---|---|
| 0 | 18 | 6 |
| 1 | 49 | 29 |
| 2 | 71 | 26 |
| 3 | 143 | 36 |
| 4 | 143 | 79 |

The result is a dried charge transport layer having a thickness of 29 micrometers and containing 43 percent by weight N,N'-diphenyl-N,N'-bis(3-methylphenyl)-(1,1' biphenyl)-4, 4' diamine and 57 percent by weight polycarbonate.

EXAMPLE II

A photoreceptor identical to the photoreceptor of Example I was prepared except that instead of forming the charge transport layer using in a single extrusion coating pass, an identical charge transport coating solution composition was applied by extrusion coating in two coating passes. The slot die had a slot height of 457 micrometers. Sufficient wet thickness was deposited (93 micrometers) so that the dried thickness of the extruded charge transport layer were measured after drying, the dried thickness would be 14.5 micrometers thick. This charge transport layer deposited in the first extrusion coating pass was dried according to Table 1. After formation of the first dried charge transport layer, a second 93 micrometer wet layer was deposited by slot die on top of the first. The second charge transport coating was also dried according to Table 1 to form a dried charge transport layer having a thickness of 14.5 micrometers. The combined dried thickness of the first and second charge transport layers was 29 micrometers. The first and second charge transport layers as well as the combination contained 43 percent by weight N,N'-diphenyl-N,N'-bis(3- methylphenyl)-(1,1' biphenyl)-4,4' diamine and 57 percent by weight polycarbonate.

Interference images were generated by illuminating the charge transport layers of the photoreceptors of Examples I and II with monochromatic light. FIGS. 1–3 are essentially topographical maps of the transport layer thickness. Each line (fringe) in FIGS. 1–3 represent a 0.26 micron change in thickness. By counting the number of closed loop fringes in the pictures over a defined area, a measurement of the thickness uniformity can be made.

In addition the width in each fringe is proportional to the steepness of the thickness change. Therefore numerous sharply defined fringes are analogous to a high, jagged mountain range. Widely spaced diffuse fringes (that appear poorly focused) are analogous to low, softly rolling hills.

Illustrated in FIG. 1 is a monochromatic interference image of high frequency thickness variability of the single coating pass 29 micrometer thick charge transport layer of the control photoreceptor of Example I. By counting the fringes, the estimated thickness variability is about 1.0–1.3 micrometers per sq. cm.

FIG. 2 illustrates a monochromatic interference image of high frequency thickness variability of the 14.5 micrometer thick first coating pass charge transport layer formed by part of the photoreceptor fabrication process of this invention, the total thickness of the charge transport layer at this stage being equal to the thickness of only the first coating pass charge transport layer prepared as described in Example II. In this case, the thickness variability is about 0.2 micrometer per sq. cm. or less.

FIG. 3 illustrates a monochromatic interference image of high frequency thickness variability of the 29 micrometer thick charge transport layer formed by the combination of the two 14.5 micrometer thick coatings prepared by the first and second coating passes of the photoreceptor fabrication process of this invention as described in Example II. With the second pass, the thickness variability has now increased significantly, remaining at about 0.2 micrometer per sq. cm or less.

FIGS. 2 and 3 show significant improvements in uniformity compared with FIG. 1 as evidenced both by the reduction in the number of interference fringes and by the obvious broadening of the few remaining fringes.

FIGS. 4 and 5 compare a grey density print test with the control photoreceptor of Example I (represented by FIG. 4) with a grey density print test with the multipass photoreceptor described in Example II (represented by FIG. 5). From a comparison of the Figures, a significant improvement in uniformity of the grey density print is obvious with raindrops visible in the print of FIG. 4 and raindrops absent in the print of FIG. 5.

EXAMPLE III

A photoreceptor was prepared by forming coatings using conventional coating techniques on a substrate comprising vacuum deposited titanium layer on a polyethylene terephthalate film (Melinex®, available from ICI). The first coating was a siloxane blocking layer formed from hydrolyzed gamma aminopropyltriethoxysilane having a dried thickness of 0.005 micrometer (50 Angstroms). The second coating was an adhesive layer of polyester resin (49,000, available from E. I. duPont de Nemours & Co.) having a dried thickness of 0.005 micrometer (50 Angstroms). The next coating was a charge generator layer containing 2.8 percent by weight hydroxygallium phthalocyanine particles, dispersed in 2.8 percent by weight poly(4,4-diphenyl-1,1-cyclohexne carbonate) (PCZ-200, available from Mitsubishi Gas.) having an optical density of 0.95 (a dried thickness of about 0.4 micrometer). A charge transport layer was formed on the charge generator layer by depositing a single coating with a slot coating die in a single coating pass, the coating containing a solution of 8.5 percent by weight N,N'-diphenyl-N,N'-bis(3-methylphenyl)-(1,1' biphenyl)-4,4' diamine, 8.5 percent by weight poly(4,4-isopropylidene-diphenylene) carbonate film forming binder (Makrolon, available from Bayer), and 85 percent by weight methylene chloride solvent. The viscosity of this solution was about 800 centipoises. The extrusion die had a slot height of 457 micrometers. The coating wet thickness was 186 micrometers and containing 50 percent by weight N,N'-diphenyl-N,N'-bis(3-methylphenyl)-(1,1' biphenyl)-4,4' diamine and 50 percent by weight polycarbonate. This coating was dried according to Example I to form a layer having a dried thickness of 29 micrometers.

The photoreceptor of Example III was then coated with an anti-curl layer solution containing 8.3 percent weight poly (4,4-isopropylidene-diphenylene) carbonate film forming binder (Makrolon, available from Bayer), 4.4 percent by weight polyester adhesive (PE200 available from), 0.48 percent silica, and 90.5 percent by weight methylene chloride. The wet coating wet thickness was about 174 micrometers. This coating was dried in a 5 zone drier with the following time/temperature profile:

TABLE 2

Dryer Time/Temperature Profile -Anti Curl Layer

| Zone | Temperature, ° C. | Residence Time, sec. |
|---|---|---|
| 0 | 18 | 8 |
| 1 | 43 | 37 |
| 2 | 60 | 33 |
| 3 | 107 | 46 |
| 4 | 107 | 101 |

The dry thickness of the anti-curl layer was about 18 micrometers.

EXAMPLE IV

A photoreceptor identical to the photoreceptor of Example III was prepared except that instead of forming the charge transport layer in a single extrusion coating pass, an identical charge transport coating solution composition was applied by extrusion coating in two coating passes. The slot die had a slot height of 457 micrometers. Sufficient wet thickness was deposited (93 micrometers) so that the dried thickness of the extruded charge transport layer would be 14.5 micrometers thick. This charge transport layer was then dried according to Table 1. After formation of the first dried charge transport layer, a second 93 micrometer wet layer was deposited by slot die on top of the first. The second charge transport coating was also dried according to Table 1 to form a dried charge transport layer having a thickness of 14.5 micrometers. The combined dried thickness of the first and second charge transport layers was 29 micrometers. The first and second charge transport layers as well as the combination contained 50 percent by weight N,N'-diphenyl-N,N'-bis(3-methylphenyl)-(1,1' biphenyl)-4,4' diamine and 50 percent by weight polycarbonate.

The photoreceptor of Example IV was then coated with an anti-curl layer solution containing 8.3 percent by weight poly(4,4-isopropylidene-diphenylene) carbonate film forming binder (Makrolon, available from Bayer), 4.4 percent by weight polyester adhesive (Vitel PE200 available from Goodyear Tire and Rubber Co.), 0.48 percent silica, and 90.5 percent by weight methylene chloride. The wet coating wet thickness was about 97 micrometers. The coating was dried according to Table 2. The dry thickness of the anti-curl layer was about 10 micrometers.

FIGS. 6 and 7 compare the photoreceptor curl in the cross process and in the machine direction respectively for the photoreceptors of Examples III and IV. Surprisingly the multipass photoreceptor (Example IV ) has significantly less curl than the single pass control photoreceptor (Example III) even though the anticurl layer is thinner. Thus a 59 percent thicker anticurl layer is required to flatten a photoreceptor having a charge transport layer formed by single pass coating compared to a charge transport layer formed by multiple pass coating. This clearly shows that the multiple pass fabrication of a charge transport layer produces a photoreceptor with significantly less internal stress that the single pass coating process.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for fabricating a flexible electrophotographic imaging member comprising:

providing an imaging member comprising a flexible substrate coated with a charge generating layer having an exposed surface, applying with an extrusion die coater a first coating solution comprising a charge transporting small molecule and film forming binder to the exposed surface to form a first charge transporting layer having a thickness greater than about 13 micrometers and less than about 20 micrometers in the dried state and an exposed surface, and applying with an extrusion die coater at least a second coating solution having a composition substantially identical to the first solution to the exposed surface of the first charge transporting layer to form at least a second continuous charge transporting layer, the at least second charge transporting layer having a thickness greater than about 13 micrometers and less than about 20 micrometers in the dried state, the at least second charge transporting layer, and any subsequently applied coating solution having a composition substantially identical to the first solution, wherein a total of three charge transporting layers are formed and each layer has a thickness in the dried state of greater than about 13 micrometers and less than about 20 micrometers and the total combined thickness of all charge transporting layers in the dried state is greater than about 39 micrometers and less than about 60 micrometers.

2. A process according to claim 1 wherein the first solution has a solids concentration greater than about 13 percent total solids based on the total weight of the coating solution.

3. A process according to claim 1 wherein the first solution has a viscosity greater than about 400 centipoises.

4. A process according to claim 1 wherein the first solution has a viscosity between about 400 centipoise and about 1,500 centipoise.

5. A process according to claim 1 wherein toner images formed during image cycling with the resulting electrophotographic imaging are free of raindrop image defects.

6. A process for fabricating a flexible electrophotographic imaging member comprising:

providing an imaging member comprising a flexible substrate coated with a charge generating layer having an exposed surface, applying with an extrusion die coater a first coating solution comprising a charge transport small molecule and film forming binder to the exposed surface to form a first charge transporting layer having a thickness of greater than about 13 micrometers and less than about 20 micrometers in the dried state and an exposed surface, and applying with an extrusion die coater at least a second coating solution having a composition substantially identical to the first solution to the exposed surface of the first charge transporting layer to form at least a second continuous charge transporting layer, the at least second charge transporting layer having a thickness greater than about 13 micrometers and less than about 20 micrometers in the dried state, the at least second charge transport layer and any subsequently applied coating solution having a composition substantially identical to the first solution, wherein a total of four charge transporting layers are formed and each layer has a thickness in the dried state of greater than about 13 micrometers and less than about 20 micrometers and the total combined thickness of all charge transporting layers in the dried state is greater than about 52 micrometers and less than about 80 micrometers.

* * * * *